US009777354B2

(12) United States Patent
Imataka et al.

(10) Patent No.: US 9,777,354 B2
(45) Date of Patent: Oct. 3, 2017

(54) CASE HARDENING STEEL MATERIAL

(71) Applicants: NIPPON STEEL & SUMITOMO METAL CORPORATION, Tokyo (JP); HONDA MOTOR CO., LTD., Tokyo (JP)

(72) Inventors: Hideki Imataka, Tokyo (JP); Masayuki Horimoto, Tokyo (JP); Gen Kato, Saitama (JP); Mitsuru Fujimoto, Saitama (JP)

(73) Assignees: NIPPON STEEL & SUMITOMO METAL CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 214 days.

(21) Appl. No.: 14/396,824

(22) PCT Filed: Apr. 16, 2013

(86) PCT No.: PCT/JP2013/061265

§ 371 (c)(1),
(2) Date: Oct. 24, 2014

(87) PCT Pub. No.: WO2013/161623

PCT Pub. Date: Oct. 31, 2013

(65) Prior Publication Data

US 2015/0125339 A1 May 7, 2015

(30) Foreign Application Priority Data

Apr. 25, 2012 (JP) ..... 2012-099332

(51) Int. Cl.

| | |
|---|---|
| ***C22C 38/50*** | (2006.01) |
| ***C21D 8/06*** | (2006.01) |
| ***C21D 1/06*** | (2006.01) |
| ***C22C 38/28*** | (2006.01) |
| ***C21D 6/00*** | (2006.01) |
| ***C22C 38/00*** | (2006.01) |
| ***C22C 38/04*** | (2006.01) |
| ***C22C 38/06*** | (2006.01) |
| ***C22C 38/40*** | (2006.01) |
| ***C22C 38/42*** | (2006.01) |
| ***C22C 38/02*** | (2006.01) |

(52) U.S. Cl.

CPC ..... *C22C 38/50* (2013.01); *C21D 1/06* (2013.01); *C21D 6/002* (2013.01); *C21D 8/06* (2013.01); *C22C 38/001* (2013.01); *C22C 38/002* (2013.01); *C22C 38/02* (2013.01); *C22C 38/04* (2013.01); *C22C 38/06* (2013.01); *C22C 38/28* (2013.01); *C22C 38/40* (2013.01); *C22C 38/42* (2013.01); *C21D 2211/002* (2013.01); *C21D 2211/005* (2013.01); *C21D 2211/009* (2013.01)

(58) Field of Classification Search

CPC ..... C22C 38/001; C22C 38/002; C22C 38/02; C22C 38/04; C22C 38/06; C22C 38/28; C22C 38/40; C22C 38/42; C22C 38/50; C21D 1/06; C21D 6/002; C21D 8/06; C21D 2211/002; C21D 2211/005; C21D 2211/009

See application file for complete search history.

(56) References Cited

FOREIGN PATENT DOCUMENTS

| | | |
|---|---|---|
| CN | 1225690 | 8/1999 |
| CN | 102131945 | 7/2011 |
| JP | 02-259012 | 10/1990 |
| JP | 2001-152284 | 6/2001 |
| JP | 2004-183047 | 7/2004 |
| JP | 2006-307273 | 11/2006 |
| JP | 2008-189989 | 8/2008 |
| JP | 2009-249684 | 10/2009 |
| JP | 4464864 | 5/2010 |
| JP | 2010-168628 | 8/2010 |
| JP | 2010-196094 | 9/2010 |
| JP | 4899902 | 3/2012 |
| WO | 2011/055651 | 5/2011 |

OTHER PUBLICATIONS

Imataka, Hideki, English machine translation of JP 2009-249684, Oct. 2009, p. 1-29.*

Ichinomiya et al., English machine translation of JP 2010-168628, Aug. 2010, p. 1-18.*

* cited by examiner

*Primary Examiner* — Roy King
*Assistant Examiner* — Caitlin Kiechle
(74) *Attorney, Agent, or Firm* — Clark & Brody

(57) ABSTRACT

A case hardening steel material having a chemical composition consists of, by mass percent, C: 0.15 to 0.23%, Si: 0.01 to 0.15%, Mn: 0.65 to 0.90%, S: 0.010 to 0.030%, Cr: 1.65 to 1.80%, Al: 0.015 to 0.060%, and N: 0.0100 to 0.0250%, further containing, as necessary, one or more kinds selected from Cu and Ni of predetermined amounts, the balance being Fe and impurities; $25 \leq Mn/S \leq 85$, $0.90 \leq Cr/(Si+2Mn) \leq 1.20$, and $1.16Si+0.70Mn+Cr \geq 2.20$; P, Ti and O in the impurities being $P \leq 0.020\%$, $Ti \leq 0.005\%$, and $O \leq 0.0015\%$; and having a structure consisting of 20 to 70% in an area ratio being ferrite; and the portion other than the ferrite being one or more kinds of pearlite and bainite. The steel material is used suitably as a raw material of the carburized part such as a CVT pulley shaft.

2 Claims, 3 Drawing Sheets

[Figure 1]
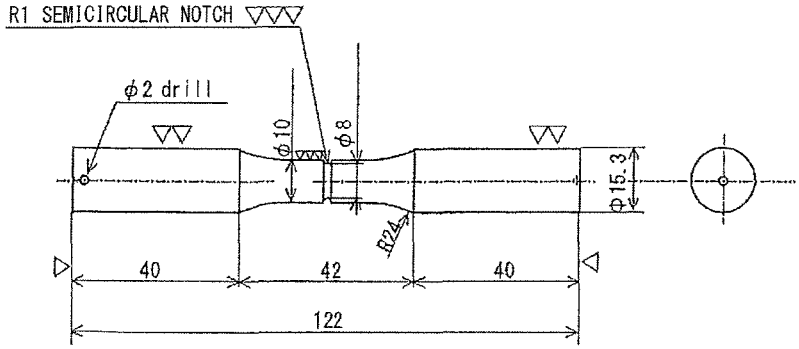
[Figure 2]
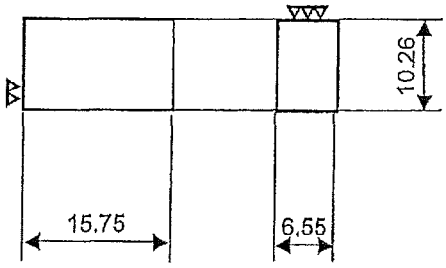
[Figure 3]
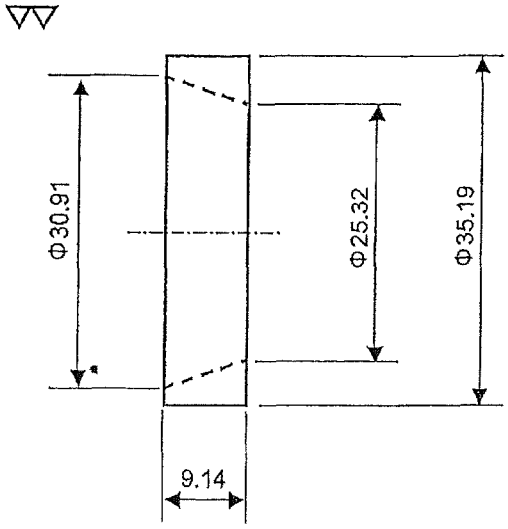

[Figure 4]
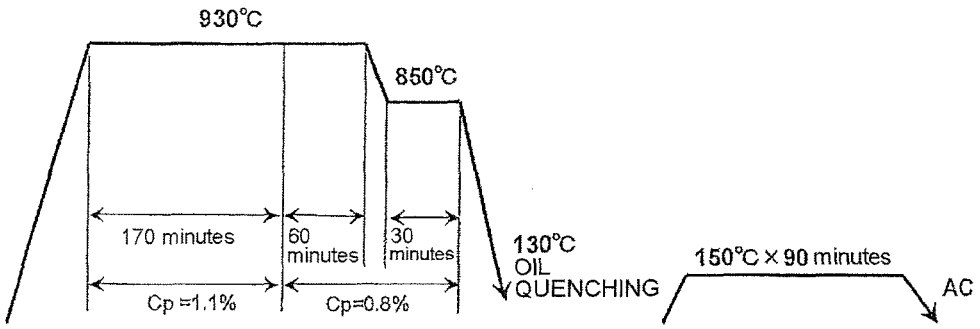
[Figure 5]
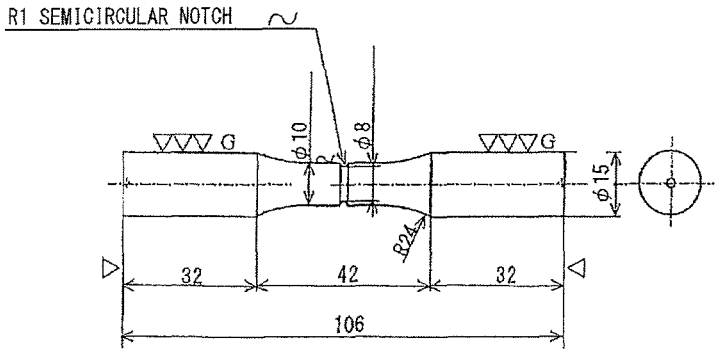
[Figure 6]
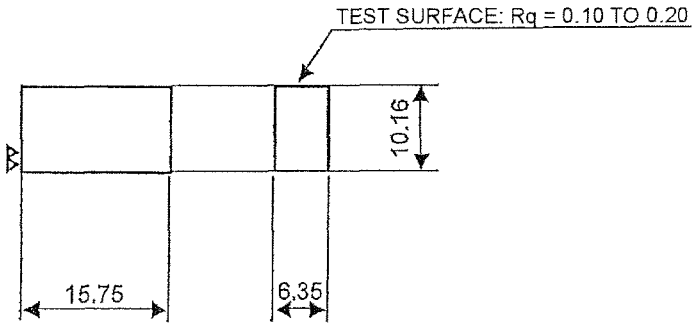

[Figure 7]
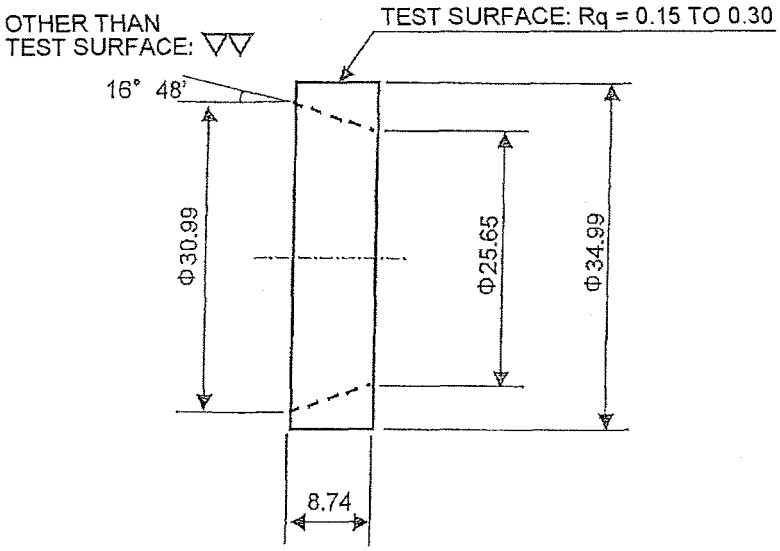
[Figure 8]
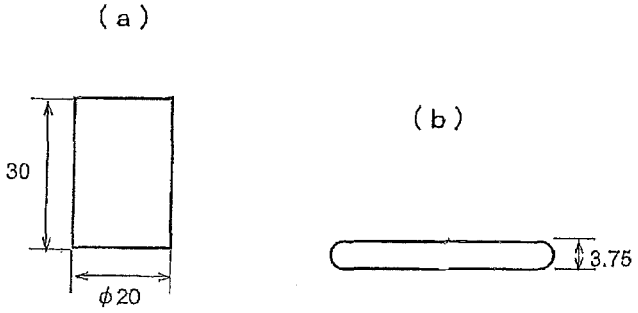
[Figure 9]
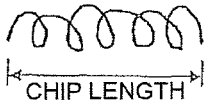

CASE HARDENING STEEL MATERIAL

TECHNICAL FIELD

The present invention relates to a case hardening steel material. More particularly, the present invention relates to a case hardening steel material that is low in component cost, moreover is excellent in bending fatigue strength and wear resistance, and is used suitably as a raw material for a carburized part such as a belt type continuously variable transmission pulley shaft (hereinafter, referred to as a "CVT pulley shaft") for a motor vehicle.

BACKGROUND ART

Automotive parts, especially parts used for a transmission such as CVT pulley shafts, are generally manufactured by surface hardening treatment such as carburizing and quenching followed by tempering, from the viewpoint of improving the bending fatigue strength and wear resistance.

In general, the "carburizing and quenching" is a treatment in which using a low-carbon "case hardening steel" as a raw material steel (base metal steel), and C has been intruded and diffused in the austenitic region at a high temperature of $Ac_3$ point or higher, then the steel is quenched.

In recent years, motor vehicles are required to have a lighter weight and higher torque. To meet this requirement, the carburized parts such as the CVT pulley shafts must have a higher bending fatigue strength and higher wear resistance than before. In this description, hereinafter an explanation may be given by referring to the "CVT pulley shaft" as a representative of the "carburized part".

When large amounts of alloying elements such as Ni, Cr and Mo are added to a case hardening steel, the CVT pulley shaft can exhibit a high bending fatigue strength and high wear resistance; however, the component cost is increased by the increased amount of alloying elements.

However, both of Ni and Mo are important elements that increase the depth of a carburized layer and the hardness of a core part (base metal), and also are elements for improving the temper softening resistance. Moreover, both of Ni and Mo also have an effect of improving the hardenability of carburized layer without increasing the depth of an intergranular oxidation layer formed on the surface during gas carburization because these elements are nonoxidizing elements.

Therefore, as a "case hardening steel", which serves as a raw material for CVT pulley shaft, a "chromium-molybdenum steel" such as SCM420H defined in JIS G 4052 (2008) is often used. However, in view of the situation of a recent steep rise in Mo cost, there is a greatly increasing demand for a case hardening steel material in which the addition amount of Mo is kept as small as possible, whereby the component cost is decreased, and moreover, the CVT pulley shaft can be provided with a high bending fatigue strength and high wear resistance.

Accordingly, to meet the above-described demand, for example, Patent Documents 1 and 2 propose a "high chromium steel for carburizing and carbo-nitriding treatment" and "method for manufacturing case-hardened product having high fatigue strength", respectively.

Specifically, Patent Document 1 discloses a "high chromium steel for carburizing and carbo-nitriding treatment" obtained by heating a steel consisting of, by mass percent, C: 0.10 to 0.30%, Si: 0.15% or less, Mn: 0.90 to 1.40%, P: 0.015% or less, Cr: 1.25 to 1.70%, Al: 0.010 to 0.050%, Nb: 0.001 to 0.050%, O: 0.0015% or less, and N: 0.0100 to 0.0200%, further containing, as necessary, one or more kinds of elements selected from (a) Ni: 0.15% or less and Mo: 0.10% or less, (b) Ti: 0.005 to 0.015%, and (c) S: 0.005 to 0.035%, Pb: 0.01 to 0.09%, Bi: 0.04 to 0.20%, Te: 0.002 to 0.050%, Zr: 0.01 to 0.20%, and Ca: 0.0001 to 0.0100%, and the balance being Fe and unavoidable impurity elements, to 1200° C. or higher, finishing hot forming such as hot rolling at a finishing temperature of 800° C. or higher, and thereafter cooling the steel to 600° C. or lower at an average cooling rate of 30° C./min or higher.

Also, Patent Document 2 discloses "method for manufacturing case-hardened product having high fatigue strength", wherein a steel material consisting of, by mass ratio, C: 0.10 to 0.30%, Mn: 0.50 to 2.0%, S: 0.01 to 0.20%, Cr: 0.50 to 1.50%, Al: 0.02 to 0.10%, and N: 0.010 to 0.025%, it being restricted such that Si: 0.10% or less, P: 0.010% or less, and O: 0.005% or less, further containing, as necessary, one or more kinds of elements selected from (a) Nb: 0.020 to 0.120% and Ti: 0.005 to 0.10%, and (b) Ni: 4.0% or less, Mo: 1.0% or less, V: 1.0% or less, and Cu: 3.0% or less, and the balance being Fe and unavoidable impurities, is worked into a required product shape and is subjected to carburizing treatment under the condition that the amount of retained austenite in a 0.02-mm outer layer is in the range of 20 to 60% in area fraction, and thereafter repeated bending stresses in the range of 70 to 120 kgf/mm$^2$ (686 to 1176 MPa) in the net maximum stress on the outermost surface are applied $10^3$ times or less to a stress concentrating part.

CITATION LIST

Patent Document

[Patent Document 1] JP2001-152284A
[Patent Document 2] JP2-259012A

SUMMARY OF INVENTION

Technical Problem

In the technique disclosed in Patent Document 1, although technical idea that the content of Si is kept low and intergranular oxidation is reduced is afforded, consideration is not given to the restraint of the depths of a intergranular oxidation layer and a non-martensitic layer (hereinafter, a general name of "carburized abnormal layer" may be collectively given), which decrease the bending fatigue strength and wear resistance. Therefore, the technique disclosed in Patent Document 1 does not necessarily provide parts such as CVT pulley shafts with ensured high bending fatigue strength and wear resistance.

In the technique disclosed in Patent Document 2 as well, although technical idea that the content of Si is restricted to 0.1% or less and intergranular oxidation is reduced is afforded, consideration is not given to the restraint of the depth of a carburized abnormal layer that decreases the bending fatigue strength. Further, in Patent document 2 consideration is also not given to the temper softening resistance of a steel material surface portion exposed to high temperatures. Therefore, the technique disclosed in Patent Document 2 as well does not necessarily provide parts such as CVT pulley shafts with ensured high bending fatigue strength and wear resistance.

Moreover, in the technique disclosed in Patent Document 2, consideration is not given to the suppression of formation of coarse MnS, which becomes a starting point of cracking when a raw material steel is hot-forged into a desired product shape, and therefore the hot workability is insufficient. Furthermore, since the coarse MnS itself decreases the bending fatigue strength, a desired high bending fatigue strength cannot be ensured in some cases.

The present invention has been made in view of the above-described situation, and accordingly an objective thereof is to provide a case hardening steel material in which even when Mo, which is an expensive element, is not added, a CVT pulley shaft can be provided with ensured high bending fatigue strength and wear resistance, which are evaluated with the case where a raw material steel is SCM420H of "chromium-molybdenum steel" defined in JIS G 4052 (2008) being a reference, the component cost is low, and moreover, the hot workability and machinability are excellent.

Solution to Problem

To solve the above-described problems, the present inventors have conducted various studies. As the result, first, the findings of the following items (a) to (d) had been obtained.

(a) In order to ensure a high bending fatigue strength and high wear resistance without the addition of Mo, the component composition of steel has to be made a composition capable of suppressing the decrease in hardenability occurring due to the decrease in Mo content.

(b) Since the decrease in bending fatigue strength occurs due to the formation of coarse MnS, in order to ensure a high bending fatigue strength, the formation of coarse MnS has to be suppressed.

(c) Coarse MnS becomes a starting point of cracking during hot working. Therefore, to suppress cracking during hot working as well, coarse MnS has to be minimized as much as possible.

(d) In order to minimize coarse MnS as much as possible, not only the respective contents of Mn and S have to be controlled, but also the content balance between Mn and S has to be optimized. Specifically, the formation of coarse MnS can be suppressed by controlling Fn1 represented by a formula of [Fn1=Mn/S], in which the element symbol in the formula represents the content in mass percent of the element, to [25≤Fn1≤85]. Therefore, in order to suppress cracking during hot working while good hot workability is ensured and also to ensure a high bending fatigue strength, the respective contents of Mn and S have to be controlled, and also these contents have to satisfy the above-described relational formula.

Accordingly, the present inventors further have conducted various studies of a steel in which the hardenability is ensured so as to offset the decrease in Mo content, and the respective contents of Mn and S and the balance thereof are optimized to suppress the formation of coarse MnS. As the result, the findings of the following items (e) to (j) were obtained.

(e) A high bending fatigue strength cannot be ensured merely by suppressing the decrease in hardenability occurring due to the decrease in Mo content and by suppressing the formation of coarse MnS. In addition to the ensuring of hardenability and the suppression of formation of coarse MnS, the depth of the carburized abnormal layer, that is, the depths of the intergranular oxidation layer and the non-martensitic layer have to be decreased.

(f) The depths of the intergranular oxidation layer and the non-martensitic layer, which are the carburized abnormal layer, can be decreased by optimizing the content balance of oxidizing elements, especially Cr, Si and Mn. Specifically, the depth of the carburized abnormal layer can be decreased by controlling Fn2 represented by a formula of [Fn2=Cr/(Si+2Mn)], in which the element symbol in the formula represents the content by mass percent of that element, to [0.90≤Fn2≤1.20],whereby a high bending fatigue strength can be ensured.

(g) In order to ensure a high bending fatigue strength, large-sized hard inclusions of type B and type D measured in conformity to method A of ASTM-E45-11, that is, thick inclusions of the inclusions of type B consisting mainly of $Al_2O_3$-based inclusions and the inclusions of type D consisting mainly of TiN-based inclusions have to be restrained. This is because the large-sized hard inclusions of type B and type D described above become starting points of fatigue fracture.

(h) In order to restrain the large-sized hard inclusions of type B and type D described above, the contents of impurities, especially the contents of Ti and O (oxygen) have to be controlled to 0.005% or less and 0.0015% or less, respectively. Also, in order to restrain the large-sized hard inclusions of type B and type D, it is desirable that a steel be melted in a vacuum furnace, or in the case a steel is melted in a converter, secondary refining be repeated, or electromagnetic stirring be performed during continuous casting.

(i) In order to steadily ensure good machinability, 20 to 70% of structure in an area ratio have to be ferrite.

(j) In order to ensure high wear resistance, it is effective to suppress temper-softening of the sliding surface. Specifically, the temper softening resistance is increased by controlling Fn3 represented by a formula of [Fn3=1.16Si+0.70Mn+Cr], in which the element symbol in the formula represents the content by mass percent of the element, to [Fn3≥2.20], whereby high wear resistance can be ensured.

The present invention was completed on the basis of the above-described findings, and the gists thereof are the case hardening steel materials described below.

(1) A case hardening steel material having a chemical composition consisting of, by mass percent, C: 0.15 to 0.23%, Si: 0.01 to 0.15%, Mn: 0.65 to 0.90%, S: 0.010 to 0.030%, Cr: 1.65 to 1.80%, Al: 0.015 to 0.060%, and N: 0.0100 to 0.0250%, the balance being Fe and impurities;

Fn1, Fn2 and Fn3 represented by the following Formulas (1), (2), and (3) being 25≤Fn1≤85, 0.90≤Fn2≤1.20, and Fn3≥2.20, respectively; and the contents of P, Ti and O in the impurities being P: 0.020% or less, Ti: 0.005% or less, and O: 0.0015% or less, and having a structure consisting of 20 to 70% in an area ratio being ferrite; and the portion other than the ferrite being one or more kinds of pearlite and bainite:

$$Fn1=Mn/S \quad (1)$$

$$Fn2=Cr/(Si+2Mn) \quad (2)$$

$$Fn3=1.16Si+0.70Mn+Cr \quad (3)$$

wherein, the element symbol in the Formulas (1), (2), and (3) represents the content by mass percent of the element.

(2) The case hardening steel material described in the above item (1), wherein in lieu of a part of Fe, one or more kinds selected from Cu: 0.20% or less and Ni: 0.20% or less, by mass percent, are contained.

Advantageous Effects of Invention

The case hardening steel material of the present invention is low in component cost, has good hot workability, and also is excellent in machinability. Moreover, a carburized part manufactured by using this case hardening steel material as a raw material has a good bending fatigue strength and good wear resistance, which are evaluated with the carburized part produced by using SCM420H of "chromium-molybdenum steel" defined in JIS G 4052 (2008) as a raw material steel being a reference. Therefore, the case hardening steel material of the present invention is used suitably as a raw material of the carburized part such as a CVT pulley shaft, which is required to have a high bending fatigue strength and high wear resistance to reduce the weight and to increase the torque.

BRIEF DESCRIPTION OF DRAWINGS

FIG. 1 is a view of a notched Ono type rotating bending fatigue test specimen used in Examples, showing a rough shape in a state of being cut out of a steel bar. The unit of dimension in the figure is "mm".

FIG. 2 is views of a block test specimen used in a block-on-ring test in Examples, showing a rough shape in a state of being cut out of a steel bar. The unit of dimension in the figure is "mm".

FIG. 3 is a view of a ring test specimen used in a block-on-ring test in Examples, showing a rough shape in a state of being cut out of a steel bar. The unit of dimension in the figure is "mm".

FIG. 4 is a diagram showing a heat pattern of "carburizing and quenching-tempering" performed on the test specimens shown in FIGS. 1 to 3 in Examples.

FIG. 5 is a view showing the finished shape of a notched Ono type rotating bending fatigue test specimen used in Examples. The unit of dimension in the figure is "mm".

FIG. 6 is views showing the finished shape of a block test specimen used in a block-on-ring test in Examples. The unit of dimension in the figure is "μm" only in the location described as "test surface: Rq=0.10 to 0.20", and is "mm" in other locations.

FIG. 7 is a view showing the finished shape of a ring test specimen used in a block-on-ring test in Examples. The unit of dimension in the figure is "μm" only in the location described as "test surface: Rq=0.15 to 0.30", and is "mm" in other locations.

FIG. 8 is schematic views for explaining a hot compression test performed in Examples, in which FIGS. 8(*a*) and 8(*b*) show the size and shape of a test specimen before and after the hot compression test, respectively. The unit of dimension in the figure is "mm".

FIG. 9 is a view for explaining the length of a chip produced in lathe turning work using an NC lathe in Examples.

DESCRIPTION OF EMBODIMENT

Hereinbelow, requirements for the present invention are explained in detail. Here, the symbol "%" for the content of each element means "% by mass".

(A) Concerning Chemical Composition:

C: 0.15 to 0.23%

C is an element essential for securing the strength of the carburized part such as a CVT pulley shaft, and therefore 0.15% or more of C has to be contained. However, when the content of C is too high, the hardness increases, and thereby the machinability is decreased. In particular, when the C content is more than 0.23%, the decrease in machinability caused by the increase in hardness becomes remarkable. Therefore, the content of C is set to 0.15 to 0.23%.

In the case where much higher machinability is required, the content of C is preferably set to 0.22% or less.

Si: 0.01 to 0.15%

Si has a hardenability improving function and a deoxidizing function. Also, Si has resistance to temper-softening, and has an effect of preventing surface softening in a situation in which the sliding surface of the CVT pulley shaft or the like is exposed to a high temperature. In order to obtain these effects, 0.01% or more of Si has to be contained. However, since Si is an oxidizing element, when the content thereof increases, Si is selectively oxidized by a minute amount of $H_2O$ or $CO_2$ contained in a carburizing gas, and Si oxides are formed on the steel surface. Therefore, the depths of the intergranular oxidation layer and the non-martensitic layer, which are the carburized abnormal layer, increase. The increase in depth of the carburized abnormal layer leads to a decrease in bending fatigue strength. Also, when the Si content increases, not only the temper-softening resisting effect is saturated, but also the carburizing property is hindered, and further the machinability is decreased. In particular, when the Si content is more than 0.15%, the decrease in the bending fatigue strength becomes remarkable, and also the decrease in the machinability becomes remarkable by the increase in depth of the carburized abnormal layer and the decrease in surface hardness caused by the hindrance to carburizing property. Therefore, the content of Si is set to 0.01 to 0.15%.

In the case where much higher bending fatigue strength is required, the content of Si is preferably set to 0.10% or less.

Mn: 0.65 to 0.90%

Mn has a hardenability improving function and a deoxidizing function. Also, Mn has an effect of suppressing temper-softening. In order to obtain these effects, the Mn content has to be 0.65% or more. However, when the Mn content increases, the hardness increases, and thereby the machinability is decreased. In particular, when the Mn content is more than 0.90%, the decrease in machinability caused by the increase in hardness becomes remarkable. Moreover, since, like Si, Mn is an oxidizing element, when the content thereof increases, Mn oxides are formed on the steel surface. Therefore, the depths of the intergranular oxidation layer and the non-martensitic layer, which are the carburized abnormal layer, increase. The increase in depth of the carburized abnormal layer leads to a decrease in bending fatigue strength. In particular, when the Mn content is more than 0.90%, the decrease in bending fatigue strength caused by the increase in depth of the carburized abnormal layer becomes remarkable. Therefore, the content of Mn is set to 0.65 to 0.90%. The Mn content is preferably set to 0.70% or more.

S: 0.010 to 0.030%

S combines with Mn to form MnS, and has a function of improving the machinability. In order to obtain the effect of improving the machinability, the S content has to be 0.010% or more. On the other hand, when the S content is more than 0.030%, coarse MnS is formed, and the hot workability and bending fatigue strength are decreased. Therefore, the content of S is set to 0.010 to 0.030%.

In order to steadily obtain the above-described effect of improving the machinability by S, the content of S is preferably set to 0.015% or more.

In the case where much higher hot workability and bending fatigue strength are required, the content of S is preferably 0.025% or less.

Cr: 1.65 to 1.80%

Cr has an effect of improving the hardenability. Cr has resistance to temper-softening, and also has an effect of preventing surface softening in a situation in which the sliding surface of the CVT pulley shaft or the like is exposed to a high temperature. In order to obtain these effects, the Cr content has to be 1.65% or more. However, when the content of Cr increases, the hardness increases, and thereby the machinability is decreased. In particular, when the Cr content is more than 1.80%, the decrease in machinability caused by the increase in hardness becomes remarkable. Moreover, since, like Si and Mn, Cr is an oxidizing element, when the content thereof increases, Cr oxides are formed on the steel surface. Therefore, the depths of the intergranular oxidation layer and the non-martensitic layer, which are the carburized abnormal layer, increase. The increase in depth of the carburized abnormal layer leads to decreases in bending fatigue strength and wear resistance. In particular, when the Cr content is more than 1.80%, the decrease in bending fatigue strength caused by the increase in depth of the carburized abnormal layer becomes remarkable. Therefore, the content of Cr is set to 1.65 to 1.80%.

In the case where much higher machinability is required, the content of Cr is preferably set to less than 1.80%.

Al: 0.015 to 0.060%

Al has a deoxidizing function. Also, Al combines with N to form AlN, and makes crystal grains fine, therefore has a function of strengthening a steel. However, when the content of Al is less than 0.015%, it is difficult to obtain the above-described effects. On the other hand, when the Al content is excessively high, hard and coarse $Al_2O_3$ is formed, and thereby the machinability is decreased. Further, the bending fatigue strength and wear resistance are also decreased. In particular, when the Al content is more than 0.060%, the machinability, bending fatigue strength, and wear resistance decrease remarkably. Therefore, the content of Al is set to 0.015 to 0.060%. The Al content is preferably 0.020% or more, and also is preferably 0.055% or less.

N: 0.0100 to 0.0250%

N makes crystal grains fine by the formation of nitrides, and therefore has an effect of improving the bending fatigue strength. In order to obtain this effect, 0.0100% or more of N has to be contained. However, when the content of N is excessively high, coarse nitrides are formed, and thereby the toughness is decreased. In particular, when the N content is more than 0.0250%, the toughness decreases remarkably. Therefore, the content of N is set to 0.0100 to 0.0250%. The N content is preferably 0.0130% or more, and also is preferably 0.0200% or less.

The case hardening steel material in accordance with the present invention has a chemical composition consisting of the above-described elements ranging from C to N, the balance being Fe and impurities, the later-described conditions of Fn1, Fn2 and Fn3 being met, and the contents of P, Ti, and O (oxygen) in the impurities being restricted to the later-described ranges.

The term "impurities" in the "Fe and impurities" of the balance means components that enter mixedly from ore and scrap used as a raw material, production environments, and the like when a steel material is produced on an industrial scale.

Fn1: 25 to 85

Even if the contents of Mn and S are within the above-described ranges, when coarse MnS is formed, the decrease in bending fatigue strength occurs. In order to ensure a high bending fatigue strength, the formation of coarse MnS has to be suppressed. Moreover, since the coarse MnS also becomes a starting point of cracking during hot working, in order to suppress the cracking during hot working, coarse MnS has to be minimized as much as possible. Therefore, the balance between the contents of Mn and S is important, and Fn1 represented by Formula (1) has to be within a fixed range.

When Fn1 is less than 25, the content of S becomes excessively high, and the formation of coarse MnS is unavoidable. On the other hand, when Fn1 is more than 85, the content of Mn becomes excessively high, and coarse MnS is formed in a central segregation zone. Therefore, in both the cases, the bending fatigue strength is decreased, and moreover, the cracking during hot working becomes liable to occur. Therefore, Fn1 is set so as to be $25 \leq Fn1 \leq 85$.

Fn2: 0.90 to 1.20

In order to provide a high bending fatigue strength without the addition of Mo, the depths of the intergranular oxidation layer and the non-martensitic layer, which are the carburized abnormal layer, have to be decreased while the hardenability is ensured. For this purpose, the contents of Cr, Si and Mn of the oxidizing elements are made within the above-described ranges, and additionally, Fn2 represented by Formula (2), which indicates the content balance of these elements, has to be within the range of 0.90 to 1.20.

When Fn2 is less than 0.90 or when it is more than 1.20, the depth of the carburized abnormal layer increases, and thereby the bending fatigue strength is decreased. Therefore, Fn2 is set so as to be $0.90 \leq Fn2 \leq 1.20$.

Fn3: 2.20 or More

In order to ensure high wear resistance, it is effective to increase the temper softening resistance of the sliding surface exposed to a high temperature. For this purpose, the contents of Si, Mn and Cr, which are elements having an effect of suppressing temper-softening, are made within the above-described ranges, and additionally, Fn3 represented by Formula (3), which indicates the content balance of these elements, has to be 2.20 or more. When Fn3 is less than 2.20, the wear resistance is decreased. Fn3 is preferably 2.60 or less.

Furthermore, in the present invention, the contents of P, Ti and O in the impurities have to be subject to especially strict restriction. The contents of these elements have to be restricted as follows: P: 0.020% or less, Ti: 0.005% or less, and O: 0.0015% or less.

In the following, explanation is given of the restriction of the contents of these elements.

P: 0.020% or Less

P is an impurity contained in a steel, and segregates at crystal grain boundaries and embrittles the steel. In particular, when the content of P is more than 0.020%, the degree of embrittlement is remarkable. Therefore, the content of P is set to 0.020% or less. The content of P in the impurities is preferably 0.015% or less.

Ti: 0.005% or Less

Ti has a high affinity to N, and therefore combines with N in a steel to form a D type inclusion TiN, which is a hard and coarse nonmetallic inclusion, whereby the bending fatigue strength and wear resistance are decreased, and further the machinability is decreased. Therefore, the content of Ti in the impurities is set to 0.005% or less.

O: 0.0015% or Less

O combines with Si, Al, and the like in a steel to form oxides. Among these oxides, especially a B type inclusion $Al_2O_3$ is hard, thus decreases the machinability, and further decreases the bending fatigue strength and wear resistance. Therefore, the content of O in the impurities is set to 0.0015% or less. The content of O in the impurities is preferably 0.0013% or less.

In the case hardening steel material in accordance with the present invention, in lieu of a part of Fe, one or more kinds of elements selected from Cu and Ni may be contained as necessary.

In the following, there are explained of the operational advantages and the reasons for restricting the contents of Cu and Ni, which are, optional elements.

Cu: 0.20% or Less

Cu has a function of enhancing the hardenability, and therefore Cu may be contained to further improve the hardenability. However, Cu is an expensive element, and also decreases the hot workability when the content thereof increases. In particular, when the content of Cu is more than 0.20%, the hot workability is decreased remarkably. Therefore, the content of Cu, when contained, is set to 0.20% or less. The content of Cu, when contained, is preferably 0.15% or less.

On the other hand, in order to steadily obtain the above-described hardenability improving effect of Cu, the content of Cu, when contained, is preferably 0.05% or more.

Ni: 0.20% or Less

Ni has a function of enhancing the hardenability. Nickel has a function of improving the toughness, and additionally, because of being a nonoxidizing element, Ni can also strengthen the steel surface without the increase in depth of the intergranular oxidation layer during carburization. Therefore, to obtain these effects, Ni may be contained. However, Ni is an expensive element, so that the excessive addition thereof leads to a rise in component cost. In particular, when the content of Ni is more than 0.20%, the cost rises greatly. Therefore, the content of Ni, when contained, is set to 0.20% or less. The content of Ni, when contained, is preferably 0.15% or less.

On the other hand, in order to steadily obtain the above-described characteristics improving effect of Ni, the content of Ni, when contained, is preferably 0.05% or more.

For the Cu and Ni, only any one kind of these elements can be contained, or two kinds of these elements can be contained compositely. The total content of these elements may be 0.40%, but is preferably 0.30% or less.

(B) Concerning Micro-structure:

The case hardening steel material of the present invention not only has the chemical composition described in the above item (A), but also has to have a structure consisting of 20 to 70% in an area ratio being ferrite, and the portion other than the ferrite being one or more kinds of pearlite and bainite. The reason for this is as follows.

The area ratio of ferrite in the steel material structure exerts an influence on the machinability. When ferrite in the structure is less than 20% in an area ratio, tool wear during cutting is accelerated, and the machinability is decreased. On the other hand, when the area ratio of ferrite is more than 70%, chips generated during lathe turning connect, and the chip disposal ability is deteriorated. In this case as well, the machinability is decreased. Therefore, 20 to 70% of structure in an area ratio is set to be ferrite. The area ratio of ferrite is preferably 30% or more.

When martensite is intermixed in the portion other than the ferrite, the hardness increases, and thereby the machinability is decreased. Therefore, the portion other than the ferrite is made to have a structure consisting of one or more kinds of pearlite and bainite.

The case hardening steel having the chemical composition described in the above item (A) can have a structure consisting of 20 to 70% in an area ratio being ferrite, and the portion other than the ferrite being one or more kinds of pearlite and bainite as described above by the process described below. For example, after being hot-rolled or hot-forged, the steel is normalized within 870 to 950° C., and is allowed to cool in the atmospheric air or is wind-cooled with fan in such a manner that the average cooling rate in the range of 800 to 500° C. is 0.1 to 3° C./s.

The following examples illustrate the present invention more specifically.

EXAMPLES

Steels 1 to 21 having the chemical compositions given in Table 1 were melted by using a converter or a vacuum furnace to prepare a cast piece or ingots.

Specifically, for steel 1, the steel was melted by using a 70-ton converter, and after the component adjustment had been made by performing secondary refining two times, the steel was continuously cast to prepare a cast piece. During continuous casting, inclusions were caused to float and removed sufficiently by controlling the electromagnetic stirring.

For steels 2 to 16 and 18 to 21, after the steels had been melted by using a 150-kg vacuum furnace, casting was performed to prepare ingots.

For steel 17, after the steel had been melted by using a 150-kg atmospheric furnace, casting was performed to prepare an ingot.

Steels 1 to 12 were steels of inventive examples whose chemical compositions were within the ranges defined in the present invention.

On the other hand, both of steels 13 and 19 were steels of comparative examples in which although the content of each component element satisfied the condition defined in the present invention, Fn2 deviated from the condition defined in the present invention, and steel 15 was a steel of comparative example in which although the content of each component element satisfied the condition defined in the present invention, Fn3 deviated from the condition defined in the present invention. Also, both of steels 20 and 21 were steels of comparative examples in which although the content of each component element satisfied the condition defined in the present invention, Fn1 deviated from the condition defined in the present invention. Further, steels 14 and 16 to 18 were steels of comparative examples in which the content of at least a component element deviated from the condition defined in the present invention.

Among the steels of comparative examples, steel 14 was a steel corresponding to SCM420H defined in JIS G 4052 (2008).

TABLE 1

| Classification | Steel | Chemical composition (mass %) Balance: Fe and impurities | | | | | | | | | | | | | |
|---|---|---|---|---|---|---|---|---|---|---|---|---|---|---|---|
| | | C | Si | Mn | P | S | Cr | Al | Ti | N | O | Others | Fn1 | Fn2 | Fn3 |
| Inventive example | 1 | 0.15 | 0.08 | 0.75 | 0.012 | 0.014 | 1.67 | 0.025 | 0.003 | 0.0160 | 0.0008 | — | 54 | 1.06 | 2.29 |
| | 2 | 0.17 | 0.13 | 0.86 | 0.010 | 0.018 | 1.70 | 0.035 | 0.001 | 0.0150 | 0.0006 | — | 48 | 0.92 | 2.45 |
| | 3 | 0.19 | 0.10 | 0.78 | 0.010 | 0.018 | 1.66 | 0.024 | 0.002 | 0.0220 | 0.0008 | — | 43 | 1.00 | 2.32 |

TABLE 1-continued

| Classification | Steel | Chemical composition (mass %) Balance: Fe and impurities | | | | | | | | | | | | | |
|---|---|---|---|---|---|---|---|---|---|---|---|---|---|---|---|
| | | C | Si | Mn | P | S | Cr | Al | Ti | N | O | Others | Fn1 | Fn2 | Fn3 |
| | 4 | 0.18 | 0.10 | 0.68 | 0.012 | 0.013 | 1.67 | 0.028 | 0.003 | 0.0180 | 0.0007 | — | 52 | 1.14 | 2.26 |
| | 5 | 0.21 | 0.09 | 0.65 | 0.010 | 0.025 | 1.67 | 0.033 | 0.004 | 0.0165 | 0.0009 | — | 26 | 1.20 | 2.23 |
| | 6 | 0.22 | 0.11 | 0.88 | 0.010 | 0.015 | 1.80 | 0.027 | 0.002 | 0.0160 | 0.0009 | — | 59 | 0.96 | 2.54 |
| | 7 | 0.20 | 0.15 | 0.73 | 0.015 | 0.015 | 1.77 | 0.030 | 0.003 | 0.0165 | 0.0008 | — | 49 | 1.10 | 2.46 |
| | 8 | 0.19 | 0.10 | 0.74 | 0.006 | 0.023 | 1.73 | 0.025 | 0.002 | 0.0150 | 0.0010 | — | 32 | 1.09 | 2.36 |
| | 9 | 0.23 | 0.12 | 0.89 | 0.010 | 0.011 | 1.80 | 0.028 | 0.003 | 0.0165 | 0.0009 | — | 81 | 0.95 | 2.56 |
| | 10 | 0.23 | 0.14 | 0.89 | 0.012 | 0.015 | 1.79 | 0.027 | 0.002 | 0.0173 | 0.0008 | — | 59 | 0.93 | 2.58 |
| | 11 | 0.21 | 0.11 | 0.81 | 0.008 | 0.016 | 1.80 | 0.040 | 0.002 | 0.0150 | 0.0009 | Ni: 0.12 | 51 | 1.04 | 2.49 |
| | 12 | 0.21 | 0.15 | 0.77 | 0.012 | 0.017 | 1.78 | 0.052 | 0.002 | 0.0170 | 0.0010 | Cu: 0.17, Ni: 0.09 | 45 | 1.05 | 2.49 |
| Comparative example | 13 | 0.16 | 0.06 | 0.66 | 0.011 | 0.014 | 1.67 | 0.030 | 0.001 | 0.0116 | 0.0014 | — | 47 | *1.21 | 2.20 |
| | 14 | 0.22 | *0.26 | 0.78 | 0.016 | 0.014 | *1.15 | 0.027 | 0.002 | 0.0150 | 0.0008 | *Mo: 0.18 | 56 | *0.63 | *2.00 |
| | 15 | 0.15 | 0.03 | 0.68 | 0.015 | 0.025 | 1.65 | 0.018 | 0.001 | 0.0105 | 0.0014 | — | 27 | 1.19 | *2.16 |
| | 16 | 0.23 | *0.35 | *2.12 | 0.015 | 0.013 | *1.10 | 0.045 | 0.001 | 0.0110 | 0.0010 | — | *163 | *0.24 | 2.99 |
| | 17 | 0.16 | 0.12 | *0.45 | 0.010 | *0.040 | *0.41 | 0.030 | *0.045 | 0.0135 | *0.0039 | — | *11 | *0.40 | *0.86 |
| | 18 | 0.23 | *0.55 | 0.70 | 0.016 | 0.011 | *2.60 | 0.030 | *0.025 | 0.0160 | 0.0014 | — | 64 | *1.33 | 3.73 |
| | 19 | 0.23 | 0.15 | 0.86 | 0.013 | 0.030 | 1.65 | 0.049 | 0.003 | 0.0245 | 0.0014 | — | 29 | *0.88 | 2.43 |
| | 20 | 0.21 | 0.14 | 0.65 | 0.012 | 0.030 | 1.72 | 0.028 | 0.002 | 0.0110 | 0.0014 | — | *22 | 1.19 | 2.34 |
| | 21 | 0.23 | 0.03 | 0.90 | 0.012 | 0.010 | 1.68 | 0.015 | 0.002 | 0.0110 | 0.0015 | — | *90 | 0.92 | 2.34 |

Fn1 = Mn/S, Fn2 = Cr/(Si + 2Mn), Fn3 = 1.16Si + 0.70M.n + Cr

*mark indicates deviation from chemical composition condition of steel defined in the present invention.

From each of the cast piece and ingots, steel bars each having a diameter of 25 mm and a diameter of 45 mm were produced by the processes described in the following items [1] and [2].

[1] Blooming:

After being held at 1250° C. for two hours, the cast piece was subjected to blooming, whereby a 180 mm-square billet was produced.

[2] Hot Working:

The surface defects of the 180 mm-square billet produced by blooming were removed with a grinder, being held at 1250° C. for 50 minutes, and thereafter the billet was hot-rolled, whereby steel bars each having a diameter of 25 mm and a diameter of 45 mm were produced.

Also, each ingot was held at 1250° C. for two hours, and thereafter was hot-forged, whereby steel bars each having a diameter of 25 mm and a diameter of 45 mm were produced.

From each 25 mm-diameter and 45 mm-diameter steel bars thus obtained, various test specimens were prepared by the processes described in the following items [3] to [6].

[3] Normalizing:

Each 25 mm-diameter steel bar was held at 900° C. for one hour, and was normalized by being allowed to cool in the atmospheric air.

Each 45 mm-diameter steel bar was held at 900° C. for one hour, then normalized by being allowed to cool in the atmospheric air for steels 1 to 5 and 13 to 15, and was held at 900° C. for one hour, then normalized by being wind-cooled with a fan for steels 6 to 12 and 16 to 21.

The average cooling rate in the range of 800° C. to 500° C. in the case where the 25 mm-diameter steel bar was allowed to cool in the atmospheric air was 0.89° C./s.

The average cooling rate in the range of 800° C. to 500° C. in the case where the 45 mm-diameter steel bar was allowed to cool in the atmospheric air was 0.46° C./s. Also, the average cooling rate in the range of 800° C. to 500° C. in the case where the 45 mm-diameter steel bar was wind-cooled with a fan was 0.85° C./s.

[4] Machining (Rough Working or Finish Working):

From the central portion of each normalized 25 mm-diameter steel bar, a notched Ono type rotating bending fatigue test specimen having a rough shape shown in FIG. 1, a block test specimen for block-on-ring test having a rough shape shown in FIG. 2, and a test specimen for a hot compression test having a finished shape having a diameter of 20 mm and a length of 30 mm were cut out in parallel with the rolling direction or the forging axis.

Also, from the central portion of the normalized 45 mm-diameter steel bar, a ring test specimen for block-on-ring test having a rough shape shown in FIG. 3, and a test specimen for a machinability test having a diameter of 40 mm and a length of 450 mm were cut out in parallel with the forging axis.

All the dimensions of the cut-out test specimens shown in FIGS. 1 to 3 are expressed in millimeters, and three kinds of inverted triangular finish marks in the figures are "triangle marks" indicating surface roughness described in Explanation Table 1 of JIS B 0601 (1982).

A part of each remaining normalized 25 mm-diameter steel bar was water-quenched, and thereafter was used for nonmetallic inclusion examination. The details of the examination method will be described later.

[5] Carburizing and Quenching-tempering:

All of the notched Ono type rotating bending fatigue test specimen, and the block test specimen and ring test specimen for block-on-ring test that had been cut out in the above item [4] were subjected to "carburizing and quenching-tempering" using the heat pattern shown in FIG. 4. The "Cp" in FIG. 4 represents a carbon potential. Also, the "130° C. oil quenching" represents quenching in an oil having an oil temperature of 130° C., and further the "AC" represents air cooling.

The notched Ono type rotating bending fatigue test specimen was subjected to the above-described treatment in a hung state in which a wire is allowed to go through a hole formed for hanging. On the other hand, the block test specimen and ring test specimen for block-on-ring test were subjected to the above-described treatment in a state of being placed flat on a jig above a wire mesh.

The oil quenching was performed by putting the test specimen into a stirred quenching oil so that quenching is performed uniformly.

[6] Machining (Finishing Work of Material Subjected to Carburizing and Quenching-tempering):

The above-described test specimens subjected to carburizing and quenching-tempering were finished to prepare the notched Ono type rotating bending fatigue test specimen shown in FIG. 5, the block test specimen for block-on-ring test shown in FIG. 6, and the ring test specimen for block-on-ring test shown in FIG. 7.

The dimensions of the test specimens shown in FIGS. 5 to 7 are expressed in millimeters excluding the locations described as "test surface: Rq=0.10 to 0.20" in FIG. 6 and "test surface: Rq=0.15 to 0.30" in FIG. 7. Also, as in FIGS. 1 to 3, three kinds of inverted triangular finish marks in FIGS. 5 to 7 are "triangle marks" indicating surface roughness described in Explanation Table 1 of JIS B 0601 (1982).

Also, the "G" attached to the finish mark in FIG. 5 is an abbreviation of working method indicating "grinding" that is defined in JIS B 0122 (1978).

Further, the "~ (swung dash)" is a "waveform symbol" that means a base metal, that is, a surface as is subjected to carburizing and quenching-tempering of the above item [5].

The "test surface: Rq=0.10 to 0.20" in FIG. 6 and "test surface: Rq=0.15 to 0.30" in FIG. 7 mean that the root-mean-square roughnesses "Rq" defined in JIS B 0601 (2001) are 0.10 to 0.20 μm and 0.15 to 0.30 μm, respectively.

For each of steels 1 to 21, there were conducted examination of micro-structure, examination of hot workability through the hot compression test, examination of nonmetallic inclusions, examination of surface hardness, examination of core hardness, examination of depth of effective hardened layer, examination of depth of intergranular oxidation layer, examination of depth of non-martensitic layer, examination of fatigue characteristics through the Ono type rotating bending fatigue test, examination of wear resistance through the block-on-ring test, and examination of machinability through lathe turning.

Hereinbelow, the details of each of the examinations are explained.

<<1>> Examination of Micro-structure:

A specimen was cut out of the R/2 portion ("R" indicates the radius of steel bar) of the transverse cross section (the surface cut perpendicularly to the rolling direction or the forging axis) of the normalized 45 mm-diameter steel bar produced in the above item [3].

After the specimen had been embedded in a resin so that the cut surface was a surface to be examined, the surface was polished into a mirror surface finish, and was etched with nital. Thereafter, the micro-structure was observed under an optical microscope at a magnification of 400. Five optional visual fields were observed, whereby the "phase" was identified, and the area ratio of ferrite was measured by image analysis.

<<2>> Examination of Hot Workability:

The test specimen for hot compression test having a diameter of 20 mm and a length of 30 mm, which was prepared as described in the above item [4], was held at 1200° C. for 30 minutes, and then compressed to a height of 3.75 mm by using a crank press with the length direction being a height as shown in FIGS. 8(*a*) and 8(*b*).

FIGS. 8(*a*) and 8(*b*) are schematic views showing the size and shape of test specimen before and after the hot compression test, respectively.

For each of the steels, five test specimens were subjected to the above-described compression test using a crank press, and cracks on the outer peripheral surface were observed visually. In the case where no crack having an opening width of 2 mm or larger was recognized on all of the five test specimens, it was evaluated that the hot workability was excellent.

<<3>> Examination of Nonmetallic Inclusions:

For the 25 mm-diameter steel bar that was normalized as described in the above item [3], the remainder of steel bar from which the block test specimen for block-on-ring test having a rough shape shown in FIG. 2 was cut out was held at 900° C. for 30 minutes, and thereafter was water-quenched.

After being water-quenched, the steel bar was embedded in a resin so that the longitudinal cross section thereof (the surface cut in parallel with the rolling direction or the forging axis so as to pass through the centerline thereof) was a surface to be examined, and the surface was polished into a mirror surface finish.

Next, in conformity to method A of ASTM-E45-11, the thicknesses of thick inclusions of the nonmetallic inclusions of type B and type D, specifically, inclusions having a thickness larger than 4 μm and 12 μm or smaller and inclusions having a thickness larger than 8 μm and 13 μm or smaller were measured, and the class judgment of each of the inclusions was made.

In the following explanation, the nonmetallic inclusions of type B and type D having a large thickness are called "BH" and "DH", respectively.

<<4>> Examination of Surface Hardness and Core Hardness

By using the notched Ono type rotating bending fatigue test specimen subjected to carburizing and quenching-tempering as described in the above item [5], the notch portion having a diameter of 8 mm was transversely cut, and was embedded in a resin so that the cut surface was a surface to be examined. Thereafter, the surface was polished into a mirror surface finish, and the surface hardness and the core hardness were examined by using a micro Vickers hardness tester.

Specifically, in conformity to "Vickers hardness test—Test method" described in JIS Z 2244 (2009), Vickers hardness (hereinafter, referred to as "HV") was measured at ten optional points at a position 0.03 mm deep from the surface of test specimen by using a micro Vickers hardness tester, specifically a microhardness tester FM-700 manufactured by FUTURE-TECH, with the test force being 0.98N. The measurement values were arithmetically averaged, and thereby the surface hardness was evaluated.

Likewise, in conformity to above-described specification of JIS, HV was measured at ten optional points in the core part, which is a portion of base metal not affected by carburization, by using a micro Vickers hardness tester with the test force being 2.94N. The measurement values were arithmetically averaged, and thereby the core hardness was evaluated.

For the block test specimen for block-on-ring test subjected to carburizing and quenching-tempering as described in the above item [5] as well, the central portion of the length thereof of 15.75 mm was transversely cut, and was embedded in a resin so that the cut surface was a surface to be examined. Thereafter, the surface was polished into a mirror surface finish, and the surface hardness and the core hardness were examined by using a micro Vickers hardness tester by the same method as that in the case where the notched Ono type rotating bending fatigue test specimen was used.

For the block test specimen for block-on-ring test subjected to carburizing and quenching-tempering as described in the above item [5], in the case where the test specimen was subjected to treatment in which it was tempered at 300° C. for one hour by using a vacuum furnace and thereafter was water-cooled as well, the surface hardness was measured by the same method as described above.

<<5>> Examination of Effective Hardened Layer Depth:

By using the resin-embedded test specimens of the notched Ono type rotating bending fatigue test specimen and the block test specimen for block-on-ring test used for the examination of surface hardness and core hardness in the above item <<4>> after merely being subjected to carburizing and quenching-tempering in the above item [5], the effective hardened layer depth was examined.

Specifically, as in the case of examination of surface hardness in the above item <<4>>, in conformity to "Vickers hardness test—Test method" described in JIS Z 2244 (2009), HV was measured in the direction directed from the mirror surface finished test specimen surface toward the center by using a micro Vickers hardness tester with the test force being 2.94N. The depth from the surface in the case where HV was 550 was measured. The minimum value of the measurement values obtained from 10 optional locations was made the effective hardened layer depth.

<<6>> Examination of Intergranular Oxidation Layer Depth and Non-martensitic Layer Depth:

By using the resin-embedded Ono type rotating bending fatigue test specimen used in the above items <<4>> and <<5>>, the intergranular oxidation layer depth and the non-martensitic layer depth were examined.

Specifically, the test specimen embedded in a resin was polished again, and the surface part of test specimen, which was in a state of being mirror surface finished and not etched, was observed in 10 optional visual fields under an optical microscope at a magnification of 1000. An oxidized layer observed along the grain intergranular in the surface part was defined as the intergranular oxidation layer, and the depths of these layers were arithmetically averaged, and thereby the intergranular oxidation layer depth was evaluated.

Further, the identical test specimen was etched with nital for 0.2 to 2 seconds, and the surface part of test specimen was observed in 10 optional visual fields under an optical microscope at a magnification of 1000. A portion in which the degree of etching was more remarkable than that of the periphery in the surface part was defined as the non-martensitic layer, and the depths of these layers were arithmetically averaged, and thereby the non-martensitic layer depth was evaluated.

<<7>> Examination of Fatigue Characteristics Through Ono Type Rotating Bending Fatigue Test:

By using the Ono type rotating bending fatigue test specimen finished in the above item [6], an Ono type rotating bending fatigue test was conducted under the following test conditions. The bending fatigue strength was evaluated by the maximum strength at the time when the test specimen did not rupture in repeating number of $10^7$.

Temperature: Room temperature

Atmosphere: in the atmospheric air

Number of rotations: 3000 rpm

With reference to the value of steel 14, which was the steel corresponding to SCM420H defined in JIS G 4052 (2008), in the case where the bending fatigue strength was 510 MPa or higher, the bending fatigue characteristics were evaluated as excellent, and this bending fatigue strength was defined as the target.

<<8>> Examination of Wear Resistance Through Block-on-ring Test:

By using the block test specimen and ring test specimen for block-on-ring test finished in the above item [6], a bock-on-ring test was conducted under the following test conditions, and thereby the wear resistance was examined.

Load: 1000N

Sliding velocity: 0.1 m/sec

Lubrication: Lubricating oil for CVT having an oil temperature of 90° C.

Total sliding distance: 8000 m

That is, the block test specimen was pressed against the ring test specimen rotating in a lubricating oil for CVT, and the block-on-ring test was conducted until the total sliding distance reached 8000 m. The amount of wear of the block test specimen after testing was evaluated. A stylus type surface roughness tester in which the radius of stylus tip end was 2 μm and the taper angle of circular cone at the tip end was 60° was used. The maximum depth obtained by moving the stylus of the roughness tester from the noncontact portion to the contact portion and to noncontact portion between the block test specimen and the ring test specimen was defined as the amount of wear.

With reference to the value of steel 14, which was the steel corresponding to SCM420H defined in JIS G 4052 (2008), in the case where the amount of wear was 7.0 μm or smaller, the wear resistance was evaluated as excellent, and this amount of wear was defined as the target.

<<9>> Machinability Test:

The outer peripheral part of the test specimen having a diameter of 40 mm and a length of 450 mm that had been prepared in the above item [4] was lathe turned by using an NC lathe, and thereby the machinability was evaluated.

The lathe turning work was performed under the turning conditions of cutting speed: 200 m/min, infeed: 1.5 mm, and feed: 0.3 mm/rev in the state in which no lubricant was used. By using a tool dynamometer, the machinability was evaluated by the cutting resistance and the chip disposal ability during lathe turning.

The cutting resistance was evaluated by determining the resultant force of cutting force, feed force, and thrust force by using the following formula.

$$\text{Cutting resistance}=\{(\text{cutting force})^2+(\text{feed force})^2+(\text{thrust force})^2\}^{0.5}$$

When the cutting resistance was 900N or smaller, the cutting resistance was evaluated as small.

The chip disposal ability was evaluated for each steel by selecting a chip whose chip length shown in FIG. 9 was at the maximum from 10 optional chips after lathe turning and by measuring the length of the selected chip. The chip disposal ability was evaluated as "excellent (○○)", "good (○)", and "poor (×)" in the case where the chip length is 5 mm or shorter, in the case where it is longer than 5 mm and 10 mm or shorter, and in the case where it is longer than 10 mm, respectively.

In the case where the cutting resistance was small, being 900N or smaller, and the chip disposal ability was evaluated excellent or good ("○○" or "○"), the machinability was evaluated as excellent, and this machinability was defined as the target.

Tables 2 to 4 give the above-described examination results collectively. In Table 2, the cooling conditions after the 45 mm-diameter steel bar had been held at 900° C. for one hour are described as "allowed to cool in atmospheric air" and "wind-cooled with fan".

TABLE 2

| Classification | Test No. | Steel | Cooling condition after 45 mm - diameter steel bar was held at 900° C. for one hour | Micro-structure Phase | Micro-structure Area ratio of F (%) | Hot workability [crack occurred or not occurred] | Nonmetallic inclusions BH [class] | Nonmetallic inclusions DH [class] |
|---|---|---|---|---|---|---|---|---|
| Inventive example | 1 | 1 | Allowed to cool in atmospheric air | F + P | 68 | Not occurred | 0.0 | 0.0 |
| | 2 | 2 | Allowed to cool in atmospheric air | F + P | 60 | Not occurred | 0.0 | 0.0 |
| | 3 | 3 | Allowed to cool in atmospheric air | F + P | 58 | Not occurred | 0.0 | 0.0 |
| | 4 | 4 | Allowed to cool in atmospheric air | F + P | 62 | Not occurred | 0.0 | 0.0 |
| | 5 | 5 | Allowed to cool in atmospheric air | F + P | 54 | Not occurred | 0.0 | 0.0 |
| | 6 | 6 | Wind-cooled with fan | F + P + B | 42 | Not occurred | 0.0 | 0.0 |
| | 7 | 7 | Wind-cooled with fan | F + P + B | 46 | Not occurred | 0.0 | 0.0 |
| | 8 | 8 | Wind-cooled with fan | F + P + B | 46 | Not occurred | 0.0 | 0.0 |
| | 9 | 9 | Wind-cooled with fan | F + B | 32 | Not occurred | 0.0 | 0.0 |
| | 10 | 10 | Wind-cooled with fan | F + B | 34 | Not occurred | 0.0 | 0.0 |
| | 11 | 11 | Wind-cooled with fan | F + P + B | 43 | Not occurred | 0.0 | 0.0 |
| | 12 | 12 | Wind-cooled with fan | F + P + B | 42 | Not occurred | 0.0 | 0.0 |
| Comparative example | 13 | *13 | Allowed to cool in atmospheric air | F + P | 68 | Not occurred | 0.0 | 0.0 |
| | 14 | *14 | Allowed to cool in atmospheric air | F + P + B | 49 | Not occurred | 0.0 | 0.0 |
| | 15 | *15 | Allowed to cool in atmospheric air | F + P | 69 | Not occurred | 0.0 | 0.0 |
| | 16 | *16 | Wind-cooled with fan | *B | *0 | Occurred | 0.0 | 0.0 |
| | 17 | *17 | Wind-cooled with fan | F + P | *85 | Occurred | 2.5 | 1.0 |
| | 18 | *18 | Wind-cooled with fan | F + B | *10 | Not occurred | 0.0 | 0.0 |
| | 19 | *19 | Wind-cooled with fan | F + B | 47 | Not occurred | 0.0 | 0.0 |
| | 20 | *20 | Wind-cooled with fan | F + P + B | 52 | Not occurred | 0.0 | 0.0 |
| | 21 | *21 | Wind-cooled with fan | F + P + B | 48 | Not occurred | 0.0 | 0.0 |

"F", "P", and "B" in micro-structure column represent ferrite, pearlite, and bainite, respectively.

For crack in hot workability column, in the case where one or more cracks each having opening width of 2 mm or larger were not recognized on outer peripheral surfaces of all the five test specimens after compression test, "not occurred" was described, and in the case where one or more cracks were recognized, "occurred" was described.

Numerical value in nonmetallic inclusions represents class judged by measuring inclusions having thickness larger than 4 μm and 12 μm or smaller and inclusions having thickness larger than 8 μm and 13 μm or smaller of nonmetallic inclusions of type B and type D in conformity to method A of ASTM-E45-11.

*mark indicates deviation from condition defined in the present invention.

TABLE 3

| Classification | Test No. | Steel | Examination using notched Ono type rotating bending fatigue test specimen: Surface hardness (HV) | Core hardness (HV) | Effective hardened layer depth (mm) | Boundary oxidation layer depth (μm) | Slack quenched layer (μm) | Examination using block test specimen for block-on-ring test: Surface hardness (HV) | Core hardness (HV) | Surface hardness after 300° C. tempering | Effective hardened layer depth (mm) |
|---|---|---|---|---|---|---|---|---|---|---|---|
| Inventive example | 1 | 1 | 701 | 288 | 0.91 | 5.4 | 11.3 | 740 | 299 | 690 | 0.81 |
| | 2 | 2 | 705 | 301 | 0.98 | 5.6 | 12.4 | 743 | 307 | 705 | 0.90 |
| | 3 | 3 | 705 | 307 | 1.00 | 5.5 | 11.3 | 745 | 316 | 708 | 0.95 |
| | 4 | 4 | 709 | 301 | 1.03 | 5.0 | 10.9 | 731 | 308 | 695 | 0.90 |
| | 5 | 5 | 715 | 305 | 1.01 | 5.3 | 10.3 | 733 | 318 | 689 | 0.95 |
| | 6 | 6 | 730 | 320 | 1.06 | 5.3 | 9.8 | 747 | 345 | 725 | 0.99 |
| | 7 | 7 | 722 | 318 | 1.05 | 5.2 | 10.5 | 743 | 335 | 712 | 0.98 |
| | 8 | 8 | 715 | 269 | 0.94 | 5.8 | 11.7 | 724 | 278 | 678 | 0.82 |
| | 9 | 9 | 730 | 335 | 1.13 | 5.9 | 11.4 | 745 | 355 | 718 | 1.03 |
| | 10 | 10 | 740 | 345 | 1.14 | 5.7 | 11.3 | 755 | 363 | 720 | 1.05 |
| | 11 | 11 | 745 | 313 | 1.11 | 5.5 | 9.3 | 757 | 330 | 732 | 0.97 |
| | 12 | 12 | 750 | 317 | 1.13 | 5.3 | 9.5 | 760 | 335 | 729 | 0.97 |
| Comparative example | 13 | *13 | 685 | 263 | 0.92 | 7.9 | 15.3 | 690 | 270 | 670 | 0.83 |
| | 14 | *14 | 707 | 295 | 1.05 | 11.8 | 15.9 | 719 | 308 | 678 | 0.96 |
| | 15 | *15 | 703 | 308 | 1.10 | 7.0 | 12.0 | 740 | 267 | 650 | 1.02 |
| | 16 | *16 | 685 | 388 | 1.01 | 12.5 | 23.0 | 705 | 396 | 670 | 0.89 |
| | 17 | *17 | 602 | 223 | 0.57 | 12.3 | 23.8 | 625 | 241 | 569 | 0.65 |
| | 18 | *18 | 672 | 367 | 0.81 | 14.5 | 25.6 | 701 | 382 | 678 | 0.89 |
| | 19 | *19 | 685 | 322 | 1.10 | 9.0 | 15.2 | 701 | 329 | 680 | 1.02 |
| | 20 | *20 | 695 | 283 | 1.07 | 5.8 | 12.8 | 705 | 295 | 675 | 1.00 |
| | 21 | *21 | 690 | 313 | 1.12 | 8.0 | 15.0 | 703 | 320 | 679 | 1.02 |

*mark indicates deviation from condition defined in the present invention.

TABLE 4

| Classification | Test No. | Steel | Bending fatigue strength (MPa) | Bending Amount of wear (μm) | Machinability Cutting resistance (N) | Machinability Chip disposal ability |
|---|---|---|---|---|---|---|
| Inventive example | 1 | 1 | 530 | 5.8 | 870 | ○○ |
| | 2 | 2 | 540 | 5.4 | 860 | ○○ |
| | 3 | 3 | 530 | 5.7 | 847 | ○○ |
| | 4 | 4 | 540 | 5.3 | 843 | ○○ |
| | 5 | 5 | 540 | 5.5 | 855 | ○○ |
| | 6 | 6 | 540 | 5.5 | 850 | ○○ |
| | 7 | 7 | 530 | 5.8 | 856 | ○○ |
| | 8 | 8 | 530 | 6.1 | 832 | ○○ |
| | 9 | 9 | 560 | 5.0 | 840 | ○○ |
| | 10 | 10 | 560 | 5.0 | 840 | ○○ |
| | 11 | 11 | 570 | 4.9 | 830 | ○○ |
| | 12 | 12 | 570 | 4.8 | 833 | ○○ |
| Comparative example | 13 | *13 | 490 | 6.7 | 840 | ○○ |
| | 14 | *14 | 510 | 7.0 | 887 | ○○ |
| | 15 | *15 | 520 | 7.8 | 844 | ○○ |
| | 16 | *16 | 460 | 6.0 | 930 | ○ |
| | 17 | *17 | 420 | 15.4 | 859 | x |
| | 18 | *18 | 450 | 6.7 | 915 | ○○ |
| | 19 | *19 | 490 | 6.3 | 860 | ○○ |
| | 20 | *20 | 490 | 6.7 | 830 | ○○ |
| | 21 | *21 | 490 | 6.7 | 855 | ○○ |

*mark indicates deviation from condition defined in the present invention.

As is apparent from Tables 2 to 4, in test Nos. 1 to 12 satisfying the conditions defined in the present invention, the steel material had good hot workability and also was excellent in machinability, and moreover, steels 1 to 12 sufficiently met the targets of a bending fatigue strength of 510 MPa or higher and an amount of wear of 7.0 μm or smaller, which were evaluated with the case of test No. 14 in which steel 14 corresponding to SCM420H of "chromium-molybdenum steel" was used as a reference, so that it is clear that a high bending fatigue strength and high wear resistance can be ensured.

In contrast, in test Nos. 13 and 15 to 21 of comparative examples deviating from the conditions defined in the present invention, for either one or both of the bending fatigue strength and the wear resistance, the targets (that is, bending fatigue strength: 510 MPa or higher, amount of wear: 7.0 μm or smaller) defined with the case of test No. 14 in which steel 14 was used as a reference could not be met. Also, in test Nos. 16 and 17, the hot workability was low, and the machinability was poor. Further, in test No. 18, the machinability was poor.

That is, in test No. 13, since Fn2, that is, [Cr/(Si+2Mn)] of steel 13 was higher than the range defined in the present invention, the bending fatigue strength was as low as 490 MPa, and therefore the target could not be met.

In test No. 15, Fn3, that is, [1.16Si+0.70Mn+Cr] of steel 15 was lower than the range defined in the present invention. For this reason, the amount of wear was as large as 7.8 μm, and therefore the wear resistance was poor.

In test No. 16, the contents of Si and Mn of steel 16 were higher than the values defined in the present invention, and the content of Cr was lower than the value defined in the present invention. Also, Fn1, that is, [Mn/S] was higher than the range defined in the present invention, and moreover, Fn2, that is, [Cr/(Si+2Mn)] was lower than the range defined in the present invention. For this reason, the bending fatigue strength was as low as 460 MPa, and therefore the bending fatigue strength was poor. Also, a crack having an opening width of 2 mm or larger was generated by the compression test using a crank press, so that the hot workability was also poor. Further, since the structure was a bainite single-phase structure that does not contain ferrite at all, the cutting resistance was large, and therefore the machinability was poor.

In test No. 17, all of the contents of S, Ti and O of steel 17 were higher than the values defined in the present invention, and the contents of Mn and Cr were lower than the values defined in the present invention. Also, Fn1, that is, [Mn/S] was lower than the range defined in the present invention, moreover, Fn2, that is, [Cr/(Si+2Mn)] was lower than the range defined in the present invention, and further, Fn3, that is, [1.16Si+0.70Mn+Cr] was lower than the range defined in the present invention. For this reason, the bending fatigue strength was as low as 420 MPa, and the amount of wear was as large as 15.4 μm. Therefore, the bending fatigue strength and the wear resistance were poor. Also, nonmetallic inclusions of type B of class 2.5 and nonmetallic inclusions of type D of class 1.0 were observed. Further, a crack having an opening width of 2 mm or larger was generated by the compression test using a crank press, so that the hot workability was also poor. Also, the area ratio of ferrite was higher than the range defined in the present invention, so that the chip disposal ability was poor, and therefore the machinability was poor.

In test No. 18, the contents of Si, Cr and Ti of steel 18 were higher than the values defined in the present invention, and moreover, Fn2, that is, [Cr/(Si +2Mn)] was also higher than the range defined in the present invention. Therefore, the bending fatigue strength was as low as 450 MPa, and the target could not be met. Also, the area ratio of ferrite was lower than the range defined in the present invention, so that the cutting resistance was large, and therefore the machinability was poor.

In test No. 19, Fn2, that is, [Cr/(Si+2Mn)] of steel 19 was lower than the range defined in the present invention. Therefore, the bending fatigue strength was as low as 490 MPa, and the target could not be met.

In test No. 20, Fn1, that is, [Mn/S] of steel 20 was lower than the range defined in the present invention. Therefore, the bending fatigue strength was as low as 490 MPa, and the target could not be met.

In test No. 21, Fn1, that is, [Mn/S] of steel 21 was higher than the range defined in the present invention. Therefore, the bending fatigue strength was as low as 490 MPa, and the target could not be met.

INDUSTRIAL APPLICABILITY

The case hardening steel material of the present invention is low in component cost, has good hot workability, and also is excellent in machinability. Moreover, a carburized part manufactured by using this case hardening steel material as a raw material has a good bending fatigue strength and good wear resistance, which are evaluated with the carburized part produced by using SCM420H of "chromium-molybdenum steel" defined in JIS G 4052 (2008) as a raw material steel being a reference. Therefore, the case hardening steel material of the present invention is used suitably as a raw material of the carburized part such as a CVT pulley shaft, which is required to have a high bending fatigue strength and high wear resistance to reduce the weight and to increase the torque.

The invention claimed is:

1. A case hardening steel material having a chemical composition consisting of, by mass percent, C: 0.15 to 0.23%, Si: 0.01 to 0.15%, Mn: 0.65 to 0.90%, S: 0.023 to 0.030%, Cr: 1.65 to 1.80%, Al: 0.015 to 0.060%, and N: 0.0100 to 0.0250%, the balance being Fe and impurities;

Fn1, Fn2 and Fn3 represented by the following Formulas (1), (2), and (3) being 25≤Fn1≤85, 0.90≤Fn2≤1.20, and Fn3≤2.20, respectively; and the contents of P, Ti and O in the impurities being P: 0.020% or less, Ti: 0.005% or less, and O: 0.0015% or less, and having a structure consisting of 20 to 70% in an area ratio being ferrite; and the portion other than the ferrite being one or more kinds of pearlite and bainite:

$$Fn1=Mn/S \quad (1)$$

$$Fn2=Cr/Si+2Mn) \quad (2)$$

$$Fn3=1.16Si+0.70Mn+Cr \quad (3)$$

wherein, the element symbol in the Formulas (1), (2), and (3) represents the content by mass percent of the element.

2. A case hardening steel material having a chemical composition consisting of, by mass percent, C: 0.15 to 0.23%, Si: 0.01 to 0.15%, Mn: 0.65 to 0.90%, S: 0.023 to 0.030%, Cr: 1.65 to 1.80%, Al: 0.015 to 0.060%, N: 0.0100 to 0.0250%, and one or more kinds selected from Cu: 0.20% or less and Ni: 0.20% or less, the balance being Fe and impurities;

Fn1, Fn2 and Fn3 represented by the following Formulas (1), (2), and (3) being 25≤Fn1≤85, 0.90≤Fn2≤1.20, and Fn3≤2.20, respectively; and the contents of P, Ti and O in the impurities being P: 0.020% or less, Ti: 0.005% or less, and O: 0.0015% or less, and having a structure consisting of 20 to 70% in an area ratio being ferrite; and the portion other than the ferrite being one or more kinds of pearlite and bainite:

$$Fn1=Mn/S \quad (1)$$

$$Fn2=Cr/(Si+2Mn) \quad (2)$$

$$Fn3=1.16Si+0.70Mn+Cr \quad (3)$$

wherein, the element symbol in the Formulas (1), (2), and (3) represents the content by mass percent of the element.

* * * * *